United States Patent [19]

Ohashi

[11] 4,292,615

[45] Sep. 29, 1981

[54] SWITCHING ELEMENT

[76] Inventor: Shigeo Ohashi, 5-20 Okusawa 1-chome, Setagaya-ku, Tokyo, Japan

[21] Appl. No.: 60,083

[22] Filed: Jul. 24, 1979

Related U.S. Application Data

[63] Continuation-in-part of Ser. No. 804,205, Jun. 7, 1977, abandoned.

[51] Int. Cl.[3] ..... H01H 9/00

[52] U.S. Cl. ..... 335/205; 335/51; 335/206

[58] Field of Search ..... 335/51, 205, 207, 206; 200/264, DIG. 30, DIG. 41

[56] References Cited

U.S. PATENT DOCUMENTS

| | | | |
|---|---|---|---|
| 2,951,135 | 8/1960 | Ovshinsky | 335/207 |
| 2,971,071 | 2/1961 | Ovshinsky | 335/205 |
| 2,972,029 | 2/1961 | Ovshinsky | 335/205 |
| 3,381,248 | 4/1968 | Furth | 335/51 |
| 3,764,540 | 10/1973 | Khalafalla et al. | 252/62.52 |
| 3,917,538 | 11/1975 | Rosensweig | 252/62.52 |

*Primary Examiner*—George Harris

*Attorney, Agent, or Firm*—Lawrence I. Field

[57] ABSTRACT

A switching element having a container made of insulating material, terminals extending from the inside to outside of the container, a mixture filled and hermetically sealed in the container, the mixture being composed of conductive powder or particles which may be magnetic and of a non-conductive liquid such as contact oil. The conductive powder is primarily suspended in the liquid, and magnetic forces are applied to and removed from the above-mentioned powder or particles by magnets or the like provided outside of the container to perform switching operations.

7 Claims, 13 Drawing Figures

SWITCHING ELEMENT

CROSS REFERENCE TO RELATED APPLICATION

This application is a continuation in part application of copending U.S. Application Ser. No. 804,205 filed by me on June 7, 1977 now abandoned.

BACKGROUND OF THE INVENTION

The present invention relates to a new and novel switching element. The magnetic snap switch, magnetic relay and proximity switch are shown in U.S. Pat. Nos. 2,951,135, 2,971,071 and 2,972,029. In these patents, the switches or relays are closed by means of magnetic or magnetizable balls which are formed into a chain-like configuration, or by means of mercury.

SUMMARY OF THE INVENTION

The primary object of the present invention is to provide a new and novel switching element or device which can best meet the requirements of the day, that is, able to be made small in size, easy to produce and excellent in durability.

In order to achieve the above-mentioned object of the present invention, there is provided a switching element comprising a container and terminals airtightly extending from the inside to outside of the container, said container containing a mixture of conductive powder and non-conductive liquid hermetically sealed therein.

With the construction mentioned above, the switching element of the present invention may have the following advantages:

First, the switching element according to the present invention may be produced in a very simple method consisting of the steps of mixing powder made of conductive material with non-conductive liquid such as lubricating oil or contact oil in a proper ratio, and hermetically sealing the mixture in a container provided with terminals; therefore, it can be made small in size and is easy to produce. In addition, it does not require strip-shaped contact arms which are usually used in the conventional reed switches, and therefore can be made very compact and does not require so severe fabrication accuracy for the contact separation as the reed switch does. Moreover, the element according to the present invention is adapted to open and close its contacts through powder, and therefore unlike the conventional reed switch it can be fabricated without taking into consideration various complicated requirements such as deflection of the contact arm (determined from thickness, length and elasticity thereof) occurring when the contact arm comes into contact with the contact. Because of the above-mentioned advantages, the switching element of the present invention can be formed as a microelement.

The element according to the present invention can eliminate arcing and chattering at the time of switching operation, since it is adapted to open and close its contacts through a mixture of lubricant (non-conductive) and conductive powder as mentioned above.

According to the present invention, the powder through which the contacts are opened and closed is at all times covered with non-conductive liquid as mentioned above and, as a result, the powder and the surface of the terminal contacts are kept free of oxidation.

Thus, according to the present invention, stable contact can be maintained for a long time.

The switching element according to the present invention is very long in service life, because it is completely free of complicated mechanisms and resilient parts.

Furthermore, according to the switching element of the present invention, its contact parts are enclosed with and hermetically sealed in a container, and therefore it is dust-proof, moisture-proof and, in addition, completely free of the influence of the air.

Furthermore, according to the present invention, the conductive powder or particles are primarily suspended in the non-conductive liquid filled in a container and therefore the switch is substantially shockproof and can be used in any orientation because it is non-directional.

Still further, according to the present invention, stabler "ON" and "OFF" action is attained than the case of using balls.

Besides the switching element, the basic concept of the present invention may be applied to other various elements such as variable resistors.

The above and other objects and features of the present invention will be apparent from a reading of the following detailed description of the preferred embodiments taken in connection with the accompanying drawings, in which.

Figure 1:
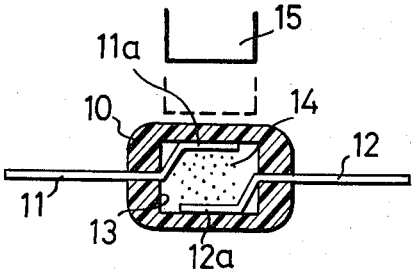
FIG. 1 is a sectional view of the switching element according to the first preferred embodiment of the present invention.
Figure 3A:
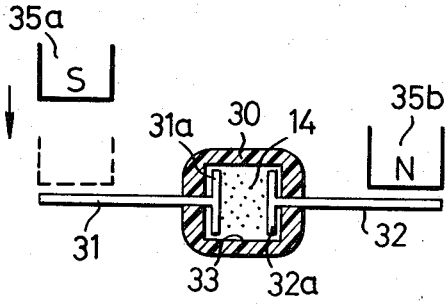
Figure 3B:
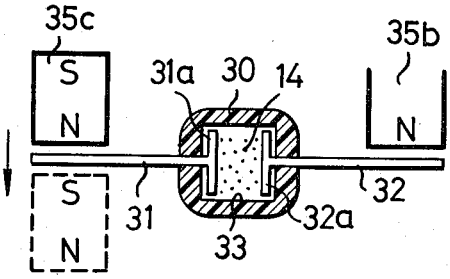
Figure 4:
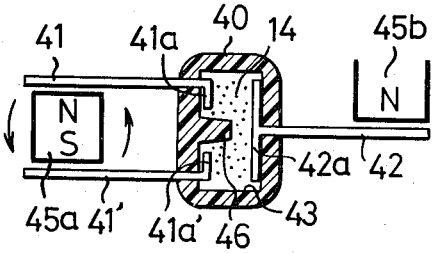
Figure 5:
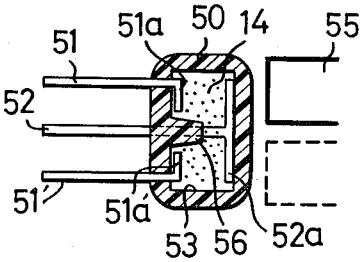
Figure 6A:
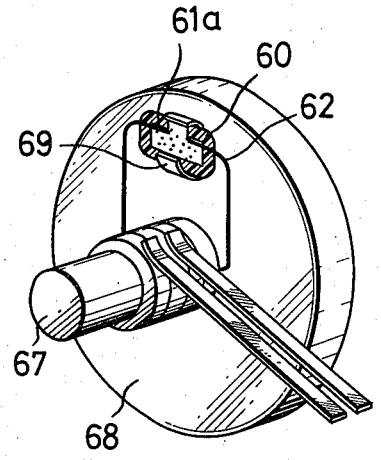
Figure 7:
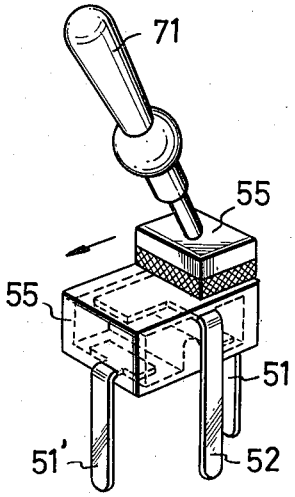
Figure 6B:
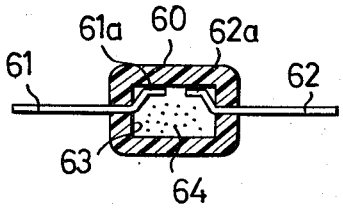
Figure 6C:
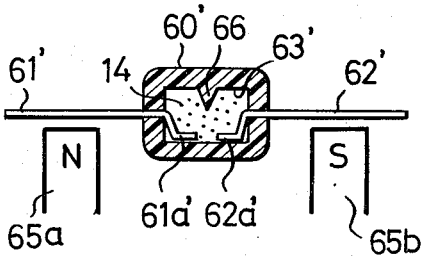
Figure 6D:
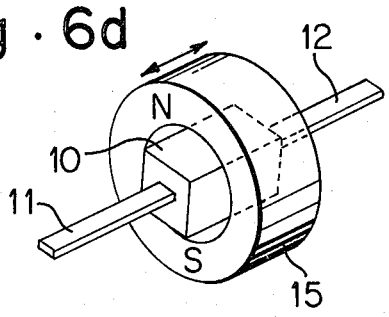
Figure 8:
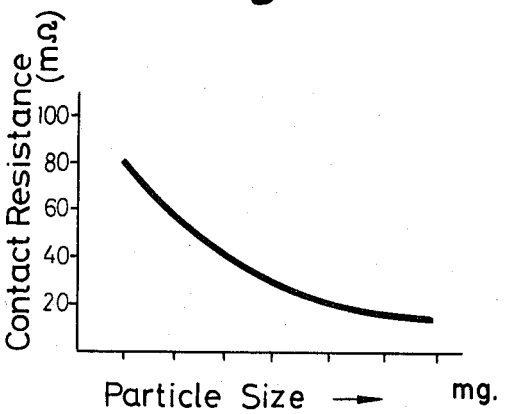
Figure 9:
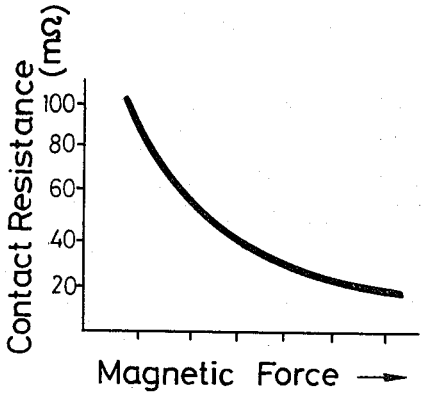
Figure 10:
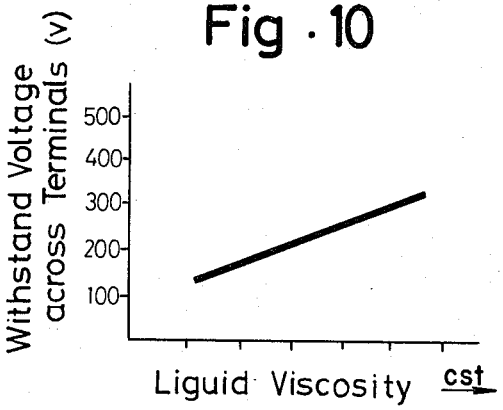

FIG. 3(*a*) and 3(*b*) are sectional views of the switching element according to the third preferred embodiment of the present invention;

FIG. 4 is a sectional view of the switching element according to the fourth preferred embodiment of the present invention;

FIG. 5 is a sectional view of the switching element according to the fifth preferred embodiment of the present invention;

FIG. 6(*a*) is a perspective view of the switch element according to the sixth preferred embodiment of the present invention;

FIG. 6(*b*) is a sectional view of a detailed sectional view of an example of the switch section of the switching element shown in FIG. 6(*a*);

FIG. 6(*c*) is a sectional view of a detailed sectional view of another example of the switch section of the switching element shown in FIG. 6(*a*);

FIG. 6(*d*) is a perspective view of the switching element of FIG. 1, operated by a cylindrical permanent magnet;

FIG. 7 is a perspective view of an example of the switching element of the present invention in practical use;

FIG. 8 depicts the relationship between the particle weight and the contact resistance;

FIG. 9 depicts the relationship between the magnetic force and the contact resistance; and FIG. 10 shows the relationship between the non-conductive liquid viscosity and the withstand voltage across terminals.

DESCRIPTION OF THE PREFERRED EMBODIMENTS

Reference is now made to FIG. 1 which shows the switching element according to the first preferred embodiment of the present invention. Reference numeral 10 designates a container for forming the body of the switching element. The container 10 is made of insulating material such as glass or plastics. A plurality of (in the drawing shown as a pair of) terminals 11 and 12 are provided at suitable portions of the container 10, being opposite to and at a proper distance from each other and extending from the inside to outside of the container 10. The terminals 11 and 12 have contacts 11*a* and 12*a*, respectively, thereby serving also as contact pieces. The container 10 contains, in its inside space 13, a predetermined amount of a mixture 14 produced by mixing conductive powder or particles of suitable grain size with non-conductive liquid such as contact oil in a predetermined ratio. The conductive powder or particles are suspended in the liquid. Thus the mixture 14 is hermetically sealed in the container 10. A permanent magnet 15 is vertically movably provided in the vicinity of (in the drawing shown as provided above) the container 10. In this embodiment, switching operation is made by the permanent magnet 15 and therefore the powder which forms the mixture 14 is preferably made of magnetic material such as iron, cobalt and nickel or alloys consisting mainly of these elements, or made of magnetic material coated with high-conductivity material such as silver, gold or copper. Usual liquid lubricant or contact oil may be used as the above-mentioned liquid which is the other component of the mixture 14; for instance, ELECTROLUBE (Trade name; marketed by NIPPON PETROLEUM CO., LTD.) may be used whose physical properties are as follows:

| | |
|---|---|
| Specific Gravity | = 0.99 at 15° C. |
| Surface tension | = 34.7 dynes/cm |
| Flashing point | = 246° C. |
| Pour point | = −46° C. |
| Boiling point | = 410° C. at 10mm atm. |
| Resistance | = 3,500 MΩ/cm$^3$ at −10° C. |
| | = 400 MΩ/cm$^3$ at +20° C. |
| | = 50 MΩ/cm$^3$ at +120° C. |

In operation, when the magnet 15 is positioned as shown in FIG. 1, its magnetic force has no influence on the mixture 14; therefore, generally the surface of each powder particle is covered with the non-conductive liquid and, as a result, powder particles are separated from each other thereby becoming independent of and insulated from each other. Accordingly, the contacts 11*a* and 12*a* of the terminals 11 and 12 are electrically disconnected from each other and therefore the switch is "OFF". When the magnet 15 is lowered to reach near enough to the container 10 as shown in FIG. 1 by a dotted line so that its magnetic field may have influence on the mixture 14 inside the container 10, the powder particles of the mixture 14 are magnetized in one direction (i.e., in the direction of the line of magnetic force), being attracted by each other. Thus the powder particles, though mixed with the above-mentioned liquid, are aligned in the above direction and simultaneously brought into contact with adjacent ones and also with the contacts 11*a* and 12*a* of the terminals 11 and 12. As a result, the terminals 11 and 12 are electrically connected to each other and thereby the switch is held "ON". Inventor's experiments indicate that, when the mixture 14 is made up of iron powder and contact oil, a switch excellent in contact surface stability can be obtained if the powder-to-oil mixing ratio is about from 7:3 to 8:2. It is as a matter of course that the switch can be made "OFF" by removing the magnetic field or by giving the switch two magnetic fields of the same polarity from both sides thereof. In the above switching operation, a further favorable on-off characteristic can be obtained in the following manner; when the switch is put into an "ON" condition, the magnet 15 is made to approach the container 10 as shown in FIG. 1 by a dotted line and at the same time another magnet of the polarity opposite to that of the magnet 15 is made to approach the container 10 from thereunder; and when the switch is put into an "OFF" condition, the magnet is held at the position shown by the dotted line in FIG. 1 and at the same time another magnet of the same polarity as that of the magnet 15 is made to approach the container 10 from thereunder. The above switching operations have been experimentally confirmed by the inventor.

It is generally considered that the relationship between the particle size and the contact resistance of the switch may be given by the curve shown in FIG. 8. Accordingly, it is desirable that the powder inside the switching element should be proper in particle size, because the contact resistance will be slightly increased when the switch is "ON" if the powder in the switching element is too small in particle size.

Instead of the above-mentioned permanent magnet 15, an electromagnet may be used to obtain the same results. The electromagnet has an advantage in that it can be fixed.

As the intensity of the magnetic field is increased, the contact resistance is decreased as a matter of course. In this connection, a cylindrical permanent magnet 15′ as shown in FIG. 6(*d*) provided with a hole through which the switching element is passed may be used instead of the magnet 15 to give the switching element a strong electric field within a limited space. It is expected that the relationship between magnetic force and contact resistance may be generally given by the curve shown in FIG. 9. FIG. 10 shows the relationship between the liquid viscosity and the withstand voltage across terminals.

The size or weight of the powder or particles and viscosity of the non-conductive liquid are properly selected so as to suspend the powder or particles in the liquid. Preferable weight of one discrete particle of the powder or particles is about 0.4–3 mgs. Preferable viscosity of the liquid is about 50–500 cst at 20° C.

The above-mentioned terminals 11 and 12 (including the contacts 11*a* and 12*a* thereof) may be made of either magnetic material or non-magnetic material. However, magnetic material is preferably used because it can provide a strong and close contact between the contacts and powder. Besides, more favorable properties may be obtained if the terminals 11 and 12 are made of magnetic material coated with silver, gold, copper or the like excellent in conductivity. If the terminals 11 and 12 are made of magnetic material, the switching element can be operated by giving a magnetic field only to the terminals, eliminating the need for giving a magnetic field to the container.

The above-mentioned embodiment is concerned with a case where one contact is provided in a one circuit. However, it is as a matter of course that a plurality of the switching elements of the construction shown in FIG. 1 may be provided side by side to open and close the switches of a plurality of circuits at the same time.

Figure 2:
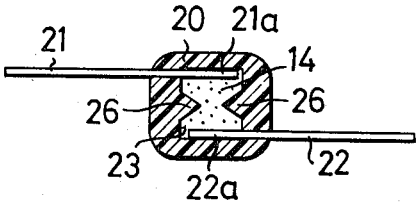
FIG. 2 is a sectional view of the switching element according to the second preferred embodiment of the present invention.

Reference is now made to FIG. 2, which is a sectional view of the switching element according to the second embodiment of the present invention. A container 20 is provided with terminals 21 and 22 having contacts 21*a* and 22*a* respectively and contains the above-mentioned mixture 14 in its inside space 23. Projections 26 are provided on the inside surface of the container 20 so that the distance between the terminals 21*a* and 22*a* as measured along the inside surface of the container 20 may be increased. With this construction, the insulation and withstand voltage across terminals can be advantageously improved. In this embodiment, switching operation may be carried out by the action of a magnet similar to the magnet 15 shown in FIG. 1.

Reference is now made to FIGS. 3(*a*) and 3(*b*) which show the switching element according to the third embodiment of the present invention. A container 30 is provided with a pair of terminals 31 and 32 extending from the inside to outside thereof. The terminals 31 and 32 are provided with contacts 31*a* and 32*a*, respectively, as in the case of each of the above embodiments. The container 30 contains and hermetically seals the above-mentioned mixture 14 in its inside space 33. In this embodiment, right and left magnets 35*a* and 35*b* in the case of FIG. 3(*a*) or 35*c* and 35*d* in the case of FIG. 3(*b*) are made to exert the attraction or repulsion thereof on the terminals 31 and 32, respectively, to perform the on-off operation of the switch. In this embodiment, therefore, it is necessary that the terminals 31 and 32 should be made of magnetic material.

Reference is now made to FIG. 4 which is a sectional view of the switching element according to the fourth embodiment of the present invention. Reference numeral 40 designates a container which forms the body of a switch. The container 40 is provided with a plurality of terminals 41, 41' and 42 extending from the inside to outside thereof. The ends of the terminals 41, 41' and 42 inside the container 40 serve as contacts 41*a*, 41*a'* and 42*a*, respectively, with which the powder or powder particles of the mixture 14 are brought into contact. In other words, this embodiment shows an example of two-contact-for-one-circuit switches, i.e., a switch having a transfer contact or make-before-break contact. The container 40 has, in its inside space 43, a partition wall 46 extending from the inside wall thereof for securely separating the contacts 41*a* and 41*a'* from each other. A predetermined amount of the above mixture 14 fills the inside space 43 of the container 40, being hermetically sealed in the container 40. In this embodiment, a permanent magnet 45*a* provided between the terminals 41 and 41' is, for instance, rotated as shown so that the attracting or repulsing action may be achieved by the aid of a permanent magnet 45*b* provided on or in the vicinity of the terminal 42. In this invention, special attention should be paid to the amount of the mixture 14 held in the container 40. More particularly, if the amount of the mixture 14 in the container 40 is too great, the terminals 41*a* and 41*a'* will be at all times electrically connected to each other thereby preventing switching operations, since they are adapted to be at all times opposite in polarity to each other. Possible methods of preventing the switching element from getting into the above state include: properly selecting the amount of the mixture 14 in the container, increasing the height of the partition wall 46 to position the tip of the partition wall 46 near the contact 42*a*, and increasing the height of the partition wall 46 to bring the tip of the partition wall 46 into contact with the contact 42*a* thereby dividing the inside space into two parts, one for the contact 41*a* and the other for the contact 41*a'*. In this embodiment, it is necessary that the terminals 41, 41' and 42 should be made of magnetic material as in the case of the third embodiment.

Reference is now made to FIG. 5 which shows the switching element according to the fifth embodiment of the present invention. A container 50 is provided with terminals 51, 51' and 52 having contacts 51*a*, 51*a'* and 52*a* respectively. The container 50 contains and hermetically seals a predetermined amount of the mixture 14 in its inside space 53 partially divided by a partition wall 56. This embodiment is concerned with a two-contacts-for-one-circuit switch similar to that of the fourth embodiment except that the switch is opened and closed by the vertical movement of the magnet 55.

Reference is now made to FIGS. 6(*a*), 6(*b*) and 6(*c*) which show the sixth embodiment of the present invention. This embodiment is concerned with a switching element used as a control switch for a solid of revolution. In the foregoing embodiments, the powder which forms a part of the mixture is shown as made of magnetic material. In this embodiment, however, the above powder is not limited to that of magnetic material. A mixture 64 may be produced by mixing conductive powder or particles (mainly made of metal) with a non-conductive liquid such as lubricating oil or the like. A container 60 is provided with terminals 61 and 62 having contacts 61*a* and 62*a* respectively. The container 60 contains and hermetically seals the above mixture 64 in the inside space 63 thereof. The container 60 is fixed on the suitable position of a solid of revolution 68 fixed on a rotary shaft 67 of a motor or the like through a bracket 69.

In operation, rotation of the solid of revolution 68 causes a centrifugal force to act on the container 60 thereby radially urging the powder of the mixture 64 in the container 60. In addition, the powder is brought into contact with the contacts 61*a* and 62*a* depending upon the rotational speed of the solid of revolution 68 and thereby the terminals 61 and 62 are electrically connected to each other and as a result the switch is brough into an "ON" condition. For instance, if the switch shown in FIG. 6(*b*) is used for a solid of revolution, no magnetic field will be required; in other words, centrifugal force alone urges the above powder toward the contacts 61*a* and 62*a* thereby bringing particles of the powder into contact with each other and also with the contacts 61*a* and 62*a* just like a bridge to turn the switch "ON". In this case, a projection may be provided at the middle of the bottom portion of the inside space 63 shown in FIG. 6(*b*).

In FIG. 6(*c*), a container 60' contains and hermetically seals a mixture 14 formed mainly of magnetic material in the inside space 63' thereof. If this switch is fixed to the solid of revolution 68 for use, it is operated as follows:

When the rotating speed of the solid of revolution 68 is relatively low, the powder of the mixture 14 is attracted by magnetic force caused by permanent magnets 65*a* and 65*b* and therefore an "ON" condition is maintained. When the rotating speed of the solid of revolution 68 becomes greater, the centrifugal force in the radial direction becomes greater than the magnetic force and as a result the powder is radially urged and therefore is separated from the contacts 61a' and 62a'; thus the switch is brought into an "OFF" condition. A projection 66 provided in the container 60' separates the powder into two parts when an centrifugal force is applied to the container 60'.

Reference is now made to FIG. 7, which is a perspective view of a toggle switch to which the present invention is practically applied. More particularly, the fifth embodiment of the present invention is applied to the toggle switch shown in FIG. 7. A lever 71 is operated to slide a permanent magnet 55 in the arrow direction thereby operating a two-contacts-for-one-circuit switch having terminals 51 and 51' and a terminal 52.

Obviously many modifications and variations of the present invention are possible in the light of the above teachings. It is therefore to be understood that within the scope of the appended claims in the invention may be practiced otherwise than as specifically described.

What is claimed is:

1. In a switching element comprising a container made of insulating material, a plurality of terminals made of magnetic material and fixed on said container and extending from the inside of said container to the outside of said container, a mixture filled and hermetically sealed in said container, and magnetic means operatively connected to said container and operable to apply a magnetic field to said mixture, the improvement which resides in said mixture, said mixture being composed of a non-conductive liquid selected from the group consisting of lubricating oil and contact oil, and powder or particles made of conductive magnetic material suspended in said non-conductive liquid.

2. The switching element as set forth in claim 1, wherein said powder or particles are coated with metal excellent in conductivity.

3. The switching element as set forth in claim 1, wherein said powder or particles are made of iron and said liquid is a contact oil and wherein the mixing ratio between said iron powder or particles and contact oil is about 7:3 to about 8:2.

4. The switching element as set forth in claim 1, wherein a plurality of said terminals are composed of a first terminal, and second and third terminals disposed with a partition wall therebetween and opposite to said first terminal.

5. The switching element as set forth in claim 4, wherein said first, second and third terminals extend from the inside of said container to the outside of said container through one side-wall thereof.

6. The switching element as set forth in claim 1, wherein a projection is provided in the inside space of said container so as to increase the distance between the contacts of said terminals as measured along the inside surface of said container.

7. The switching element as set forth in claim 1, wherein said powder or particles are a material selected from the group consisting of iron, cobalt, nickel and alloys thereof, the weight of one discrete particle of said powder or particles being about 0.4–3 mgs, and wherein the viscosity of said non-conductive liquid ranges from about 50 to 500 cst at 20° C.

* * * * *